US008110771B2

(12) United States Patent
Takahashi et al.

(10) Patent No.: US 8,110,771 B2
(45) Date of Patent: Feb. 7, 2012

(54) VACUUM INSULATING SWITCH GEAR

(75) Inventors: Keiichi Takahashi, Hitachi (JP); Kenji Tsuchiya, Hitachi (JP); Akio Nakazawa, Hitachi (JP); Hisao Kawakami, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 194 days.

(21) Appl. No.: 12/707,030

(22) Filed: Feb. 17, 2010

(65) Prior Publication Data

US 2010/0243611 A1 Sep. 30, 2010

(30) Foreign Application Priority Data

Mar. 27, 2009 (JP) ..... 2009-079236

(51) Int. Cl.
*H01H 33/66* (2006.01)

(52) U.S. Cl. ..... 218/136

(58) Field of Classification Search ..... 218/134–137
See application file for complete search history.

(56) References Cited

U.S. PATENT DOCUMENTS

| | | | | |
|---|---|---|---|---|
| 3,694,601 | A * | 9/1972 | Atkinson | 218/134 |
| 4,481,390 | A * | 11/1984 | Kashiwagi et al. | 218/134 |
| 4,540,863 | A * | 9/1985 | Bettge et al. | 218/136 |
| 4,547,638 | A * | 10/1985 | Kashimoto et al. | 218/136 |
| 4,574,169 | A * | 3/1986 | Santilli | 218/136 |
| 4,880,947 | A * | 11/1989 | Fey et al. | 218/118 |
| 5,294,761 | A * | 3/1994 | Okutomi et al. | 218/130 |
| 6,635,841 | B2 * | 10/2003 | Makino | 218/134 |
| 7,683,286 | B2 * | 3/2010 | Sato et al. | 218/134 |
| 7,880,111 | B2 * | 2/2011 | Inoue et al. | 218/136 |

FOREIGN PATENT DOCUMENTS

JP 2002-358861 12/2002

* cited by examiner

*Primary Examiner* — Truc Nguyen
(74) *Attorney, Agent, or Firm* — Brundidge & Stanger, P.C.

(57) ABSTRACT

A vacuum insulating switch gear formed by integrally molding with epoxy resin of a vacuum double-break three-position type switch including a movable contact, a fixed contact, and a vacuum container composed of an insulating cylinder for covering the movable contact and the fixed contact, a lower lid for closing a lower part of the insulating cylinder, and an upper lid for closing an upper part of the insulating cylinder and an operation rod side of the movable contact, and an earthing switch with a vacuum closed container, comprising a first silicone rubber layer coated on an upper edge corner portion of each insulating cylinder composing the vacuum containers of the switch and the earthing switch, a self fusing insulating tape layer wound around an outer surface of the first silicone rubber layer, a second silicone rubber layer coated on the self fusing insulating tape layer and an outer periphery of the each insulating cylinder, a ring easing shield installed at a position corresponding to a lower end corner portion of the each insulating cylinder after a vacuum deaeration process performed for the first and the second silicone rubber layers, and an epoxy resin portion for integrally molding the each vacuum container so as to cover the first silicone rubber layer, the self fusing insulating tape layer, the second silicone rubber layer, and the ring easing shield.

4 Claims, 7 Drawing Sheets

VACUUM INSULATING SWITCH GEAR

CLAIM OF PRIORITY

The present application claims priority from Japanese patent application serial No. 2009-079236, filed on Mar. 27, 2009, the content of which is hereby incorporated by reference into this application.

BACKGROUND OF THE INVENTION

1. Field of Technology

The present invention relates to a vacuum insulating switch gear which is miniaturized and lightened and has high performance and reliability.

2. Description of Related Art

In recent power receiving and transformation facility, the users' demands are diversified. For example, the load kind and operation condition depend upon the use purpose, so that in consideration of the requested safety, reliability, and operation maintenance and a future increase in the load, a power distribution system is planned. However, in the power distribution system plan, the control for the circuit breaker, the disconnecting switch, and the earthing switch composing the power receiving and transformation facility and the monitoring and measurement of the voltage, current, and power of the power receiving and transformation facility must be taken into account.

In this case, it is one of the problems how to minimize the installation space of the devices of the circuit breaker, disconnecting switch, and earthing switch, the controllers, and the monitoring and measuring instruments therefore, thereby suppressing the investment in the installation. To solve the problem, a vacuum insulating switch gear including a vacuum double-break three-position type switch having a breaking-disconnecting function is proposed.

In the vacuum insulating switch gear, the vacuum double-break three-position type switch and the earthing switch with a vacuum closed container are respectively stored in a vacuum container formed by a ceramic material or a metallic material and the vacuum containers and conductors are molded integrally with epoxy resin which is used as an insulating skin, thus a switching portion is unitized, miniaturized, and lightened.

On the other hand, in such switching portion, there is a great difference in the thermal expansion coefficient between the epoxy resin and the ceramic material, so that separation of the epoxy resin cast portion and generation of cracks due to thermal stress owing to temperature changes are supposed. If the epoxy resin is cracked, the insulation property is lowered and a fault such as generation of a corona discharge is caused, thus the reliability of the vacuum insulating switch gear is extremely reduced. Therefore, it is known to coat plastic resin such as silicone rubber in the gap between a required portion of the vacuum container easily cracked due to thermal stress and the epoxy resin cast portion for the purpose of easing the thermal stress and form a stress easing layer (for example, refer to Patent Document 1).

Patent Document 1: Japanese Patent Laid-open No. 2002-358861

SUMMARY OF THE INVENTION

As mentioned above, when forming the stress easing layer at a portion where the epoxy resin portion is easily cracked due to thermal force, it is important to control the optimum thickness of the stress easing layer and eliminate air gaps inside the stress easing layer. The reason is that an inappropriate thickness of the stress easing layer causes generation of cracks in the epoxy resin and interface separation and the existence of inner air gaps causes generation of a corona discharge.

The vacuum double-break three-position type switch and the earthing switch with the vacuum closed container of the vacuum insulating switch gear aforementioned are structured so as to cover each contact with the insulating cylinder of the vacuum container, so that the corner portion of the upper end of the insulating cylinder becomes an edge portion. The edge portion becomes the aforementioned portion for giving thermal stress (the required portion of the vacuum container), so that the stress easing layer must be formed at that portion.

For example, when coating plastic resin such as silicone rubber to form a stress easing layer, it must be recoated with the greatest care so as to not roll in bubbles causing a corona discharge until an appropriate thickness is obtained on the edge portion. However, the silicone rubber is liquid and sticky rubber, so it is difficult to control the coated surface thickness.

On the other hand, for example, when winding a self fusing insulating tape and forming a stress easing layer, compared with the aforementioned coating operation, the thickness can be controlled, though when winding the tape around the corner of the edge portion, a problem arises that air gaps are unavoidably generated between the tape adhered surface and the edge portion.

The present invention was developed with the foregoing in view and is intended to provide a highly-reliable vacuum insulating switch gear having a stress easing layer that is optimally processed.

(1) To accomplish the above object, the present invention provides a vacuum insulating switch gear formed by integrally molding with epoxy resin of a vacuum double-break three-position type switch including a movable contact, a fixed contact, and a vacuum container composed of an insulating cylinder for covering the movable contact and the fixed contact, a lower lid for closing the lower part of the insulating cylinder, and an upper lid for closing the upper part of the insulating cylinder and the operation rod side of the movable contact, and an earthing switch with a vacuum closed container, comprising a first silicone rubber layer coated on the upper edge corner portion of each insulating cylinder composing the vacuum containers of the switch and the earthing switch, a self fusing insulating tape layer wound around the outer surface of the first silicone rubber layer, a second silicone rubber layer coated on the self fusing insulating tape layer and the outer periphery of the each insulating cylinder, a ring easing shield installed at a position corresponding to a lower end corner portion of the each insulating cylinder after the vacuum deaeration process is performed for the first and the second silicone rubber layers, and an epoxy resin portion for integrally molding the each vacuum container so as to cover the first silicone rubber layer, the self fusing insulating tape layer, the second silicone rubber layer, and the ring easing shield.

(2) In (1) aforementioned, the first silicone rubber layer is preferably thermoset after execution of the vacuum deaeration process.

(3) In (1) aforementioned, the second silicone rubber layer is preferably thermoset after the vacuum deaeration process.

(4) In (1) aforementioned, the electrode shield portion installed at the middle of the insulating cylinders, the first silicone rubber layer and the self fusing insulating tape layer are additionally installed.

According to the present invention, the thermal stress to epoxy resin composing the mold portion can be eased, so that the crack resistant property and withstand voltage property of the integrally molded vacuum container can be improved. As a result, the reliability of the vacuum insulating switch gear is improved and a vacuum insulating switch gear withstanding long-term use can be provided.

DETAILED DESCRIPTION OF THE PREFERRD EMBODIMENTS

Hereinafter, an embodiment of the vacuum insulating switch gear of the present invention will be explained with reference to the accompanying drawings.

Figure 1:
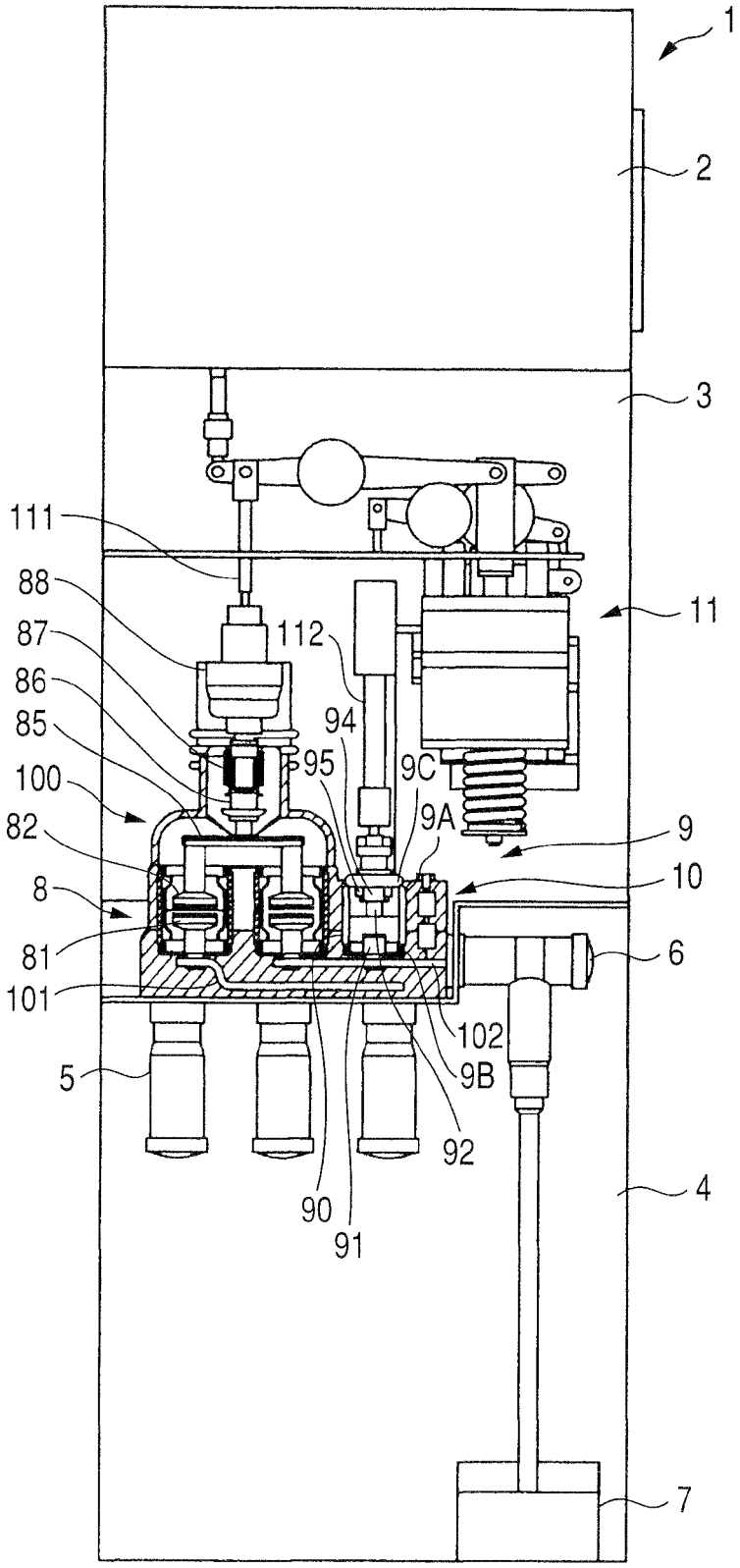
FIG. 1 is a side view showing an embodiment that the vacuum insulating switch gear of the present invention is applied as a feeder board that is partially sectioned.
Figure 2:
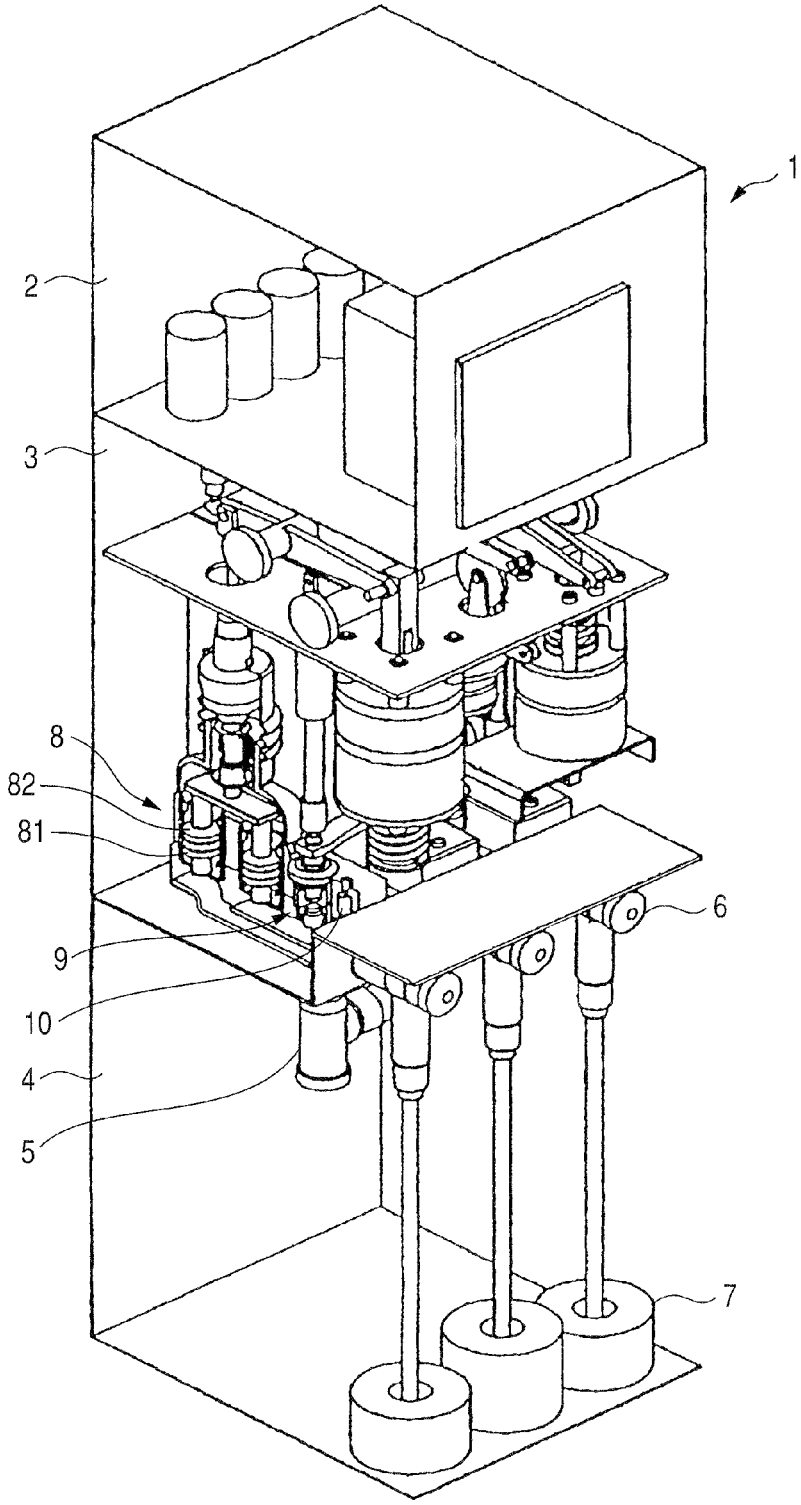
FIG. 2 is a perspective view showing the embodiment shown in FIG. 1 that the vacuum insulating switch gear of the present invention is applied as the feeder board that is partially sectioned.
Figure 3:
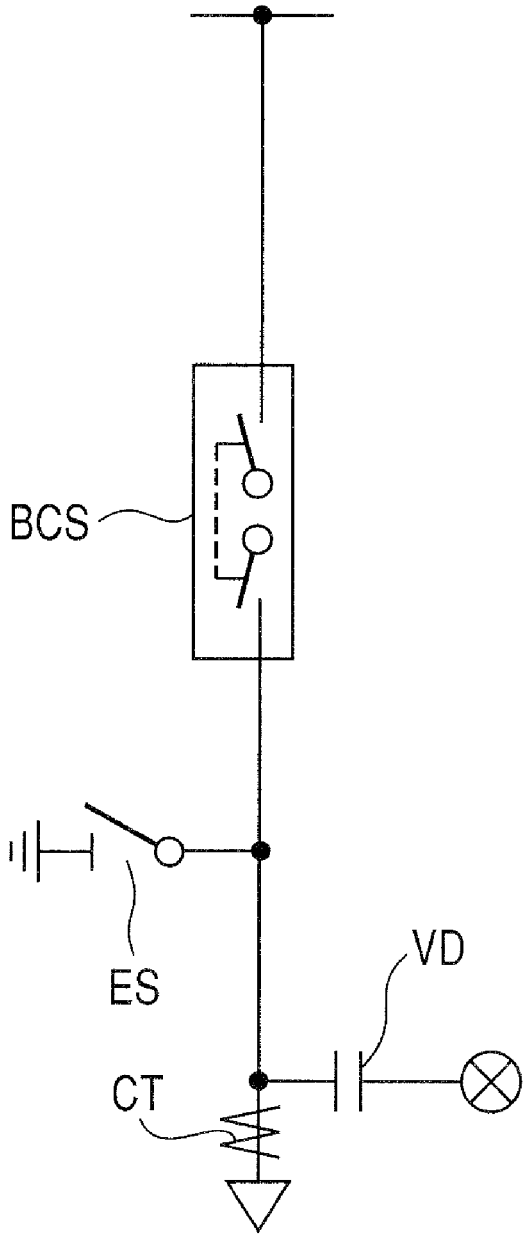
FIG. 3 is an electric circuit diagram of the embodiment shown in FIG. 1 that the vacuum insulating switch gear of the present invention is applied as the feeder board.
Figure 4:
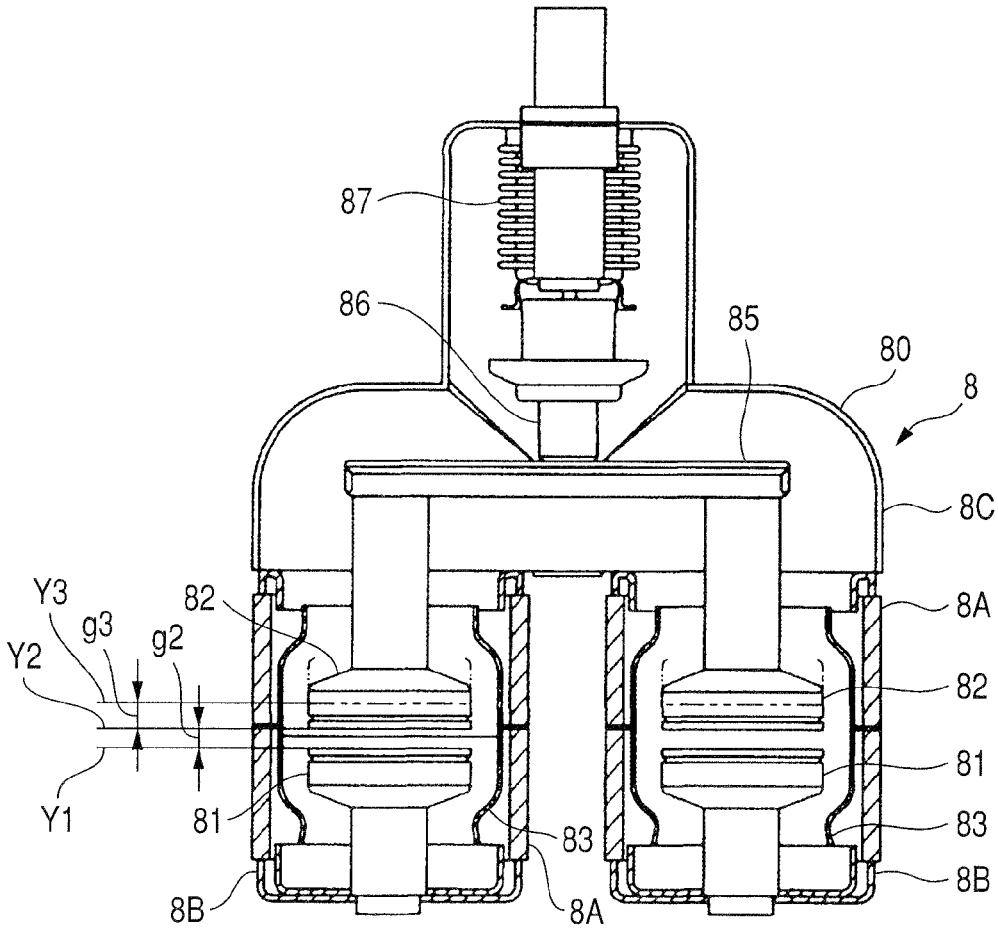
FIG. 4 is a vertical sectional view of a switching portion composing the vacuum insulating switch gear of the present invention shown in FIG. 1.

FIG. 1 is a side view showing an embodiment that the vacuum insulating switch gear of the present invention is applied as a feeder board, and FIG. 2 is a perspective view showing the embodiment shown in FIG. 1 that the vacuum insulating switch gear of the present invention is applied as the feeder board which is partially sectioned, and FIG. 3 is an electric circuit diagram of the embodiment shown in FIG. 1 that the vacuum insulating switch gear of the present invention is applied as the feeder board, and FIG. 4 is a vertical sectional view of a switching portion composing the vacuum insulating switch gear of the present invention shown in FIG. 1. In FIGS. 1 and 2, a cabinet 1 of the vacuum insulating switch gear is internally divided from the above into a control division portion 2, a high-voltage switch division portion 3, and a bus/cable division portion 4.

In the bus/cable division portion 4, a bus 5, a cable head 6 to which the line-side cable is connected, a bushing CT 7, and other components are arranged. Further, in the high-voltage switch division portion 3, a vacuum double-break three-position type switch (a breaking-disconnecting switch of a vacuum double-break three-position type switch BDS) 8, an eathing switch with a vacuum closed container (ES) 9, a voltage detector (VD) 10, and an operating unit 11 are arranged.

The bus 5 is a solid insulating bus that is made gas-less and is ensured in handling property and safety. Further, the voltage detector 10 detects a corona generated due to deterioration of the degree of vacuum in the vacuum container and improves the maintenance checking property.

The electric circuit diagram of an embodiment that the vacuum insulating switch gear of the present invention is applied as a feeder board is shown in FIG. 3.

Next, the vacuum double-break three-position type switch (BDS) 8, the earthing switch with the vacuum closed container (ES) 9, and the voltage detector (VD) 10 which are arranged in the high-voltage switch division portion 3, as shown in FIG. 1, are integrally molded by epoxy resin. By doing this, the switching portion is unitized and made compact and light in weight. The unitized switching portion 100 has a phase separation structure, and furthermore, a shielding layer is arranged between the phases, thus generation of a short-circuit trouble between the phases is suppressed. Further, the outer surface of the mold is grounded by coated conductive paint, thus the contact safety is ensured.

The detailed constitution of the switching portion 100 will be additionally explained by referring to FIGS. 1 and 4. The vacuum double-break three-position type switch (BDS) 8 includes a vacuum container 80 composed of two insulating cylinders 8A for covering movable contacts 82 and fixed contacts 81, lower lids 8B for closing the lower parts of the insulating cylinders, and an upper lid 8C made of stainless steel for closing the upper parts of the two insulating cylinders and the operation rod sides of the movable contacts 82.

By the two fixed contacts 81 stored in the insulating cylinders 8A and the insulating cylinders 8A, respectively, and the movable contacts 82 thereof, the double-break is structured. Further, in the insulating cylinders 8A, 8A, cylindrical electrode shields 83 are installed so as to cover the movable contacts 82 and fixed contacts 81 thereof.

The one of fixed contact 81 on the left side shown in FIG. 1 is connected to the bus 5 via a conductor 101. Further, the other one of fixed contact 81 on the right side shown in FIG. 1 is connected to the cable head 6 via a conductor 102.

The one of movable contact 82 and the other one of movable contact 82 are connected by a movable conductor 85 reinforced by a metal not annealed at a high temperature such as stainless steel. To the movable conductor 85, a vacuum insulating operation rod 86 is connected. The vacuum insulating operation rod 86 is led outside the vacuum container 80 via a metallic bellows 87 and is connected to an intra-air insulating operation rod 88. The intra-air insulating operation rod 88 is connected to an operation rod 111 operated by the operating unit 11.

The one of movable contact 82 and the other one of movable contact 82 stop at the three positions of a closed position Y1 for supplying power by the operation rod 111 as shown in FIG. 4, an open position Y2 for interrupting a current, and a disconnecting position Y3 for ensuring the safety of a checking operator for a surge voltage such as lightning.

The two movable contacts 82 aforementioned, as shown in FIG. 4, respectively ensure a breaking gap g2 at the open position Y2 and a disconnecting gap g3 at the disconnecting position Y3. The disconnecting gap g3 is set so as to have an inter-pole distance about two times that of the breaking gap g2. As mentioned above, the disconnecting gap g3 at the time of disconnection is set to about two times the breaking gap g2 and a plurality of disconnecting gaps (in the example, two) are installed, thus multi-stage insulation is realized.

Next, the earthing switch with the vacuum closed container (ES) 9, as shown in FIG. 1, includes a vacuum container 90 composed of an insulating cylinder 9A for covering a movable contact 92 and a fixed contact 91 connected to a conductor 102, a lower lid 9B for closing the lower part of the insulating cylinder 9A, and an upper lid 9C made of stainless steel for closing the upper part of the insulating cylinder and the operation rod side of the movable contact 92. To the moving contact 92, a vacuum insulation operation rod 94 is connected. The vacuum insulation operation rod 94 is led outside the vacuum container 90 via a metallic bellows 95 and is connected to an insulation operation rod 112 for the earthing switch.

Figure 5:
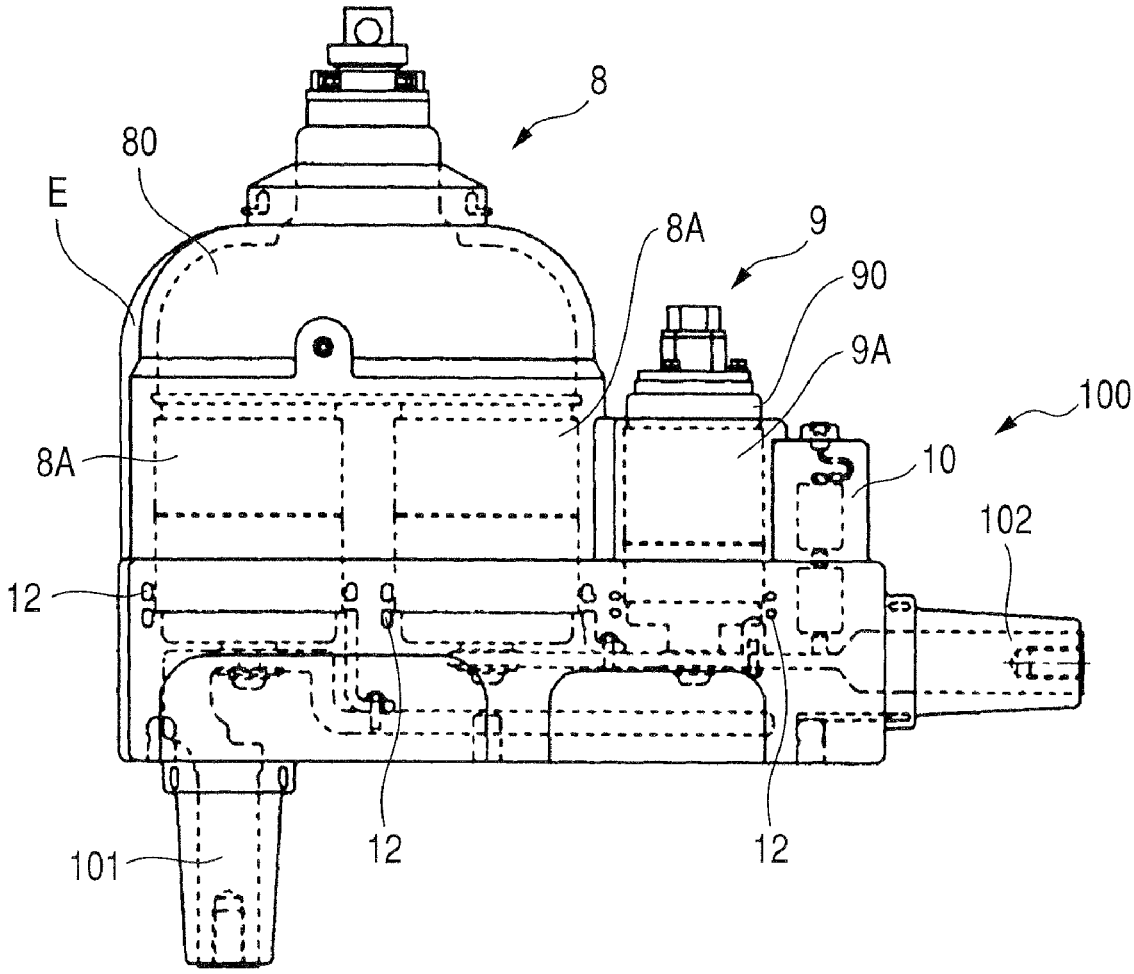
FIG. 5 is a front view showing the internal constitution of the switching portion 100 composing the vacuum insulating switch gear of the present invention.
Figure 6A:
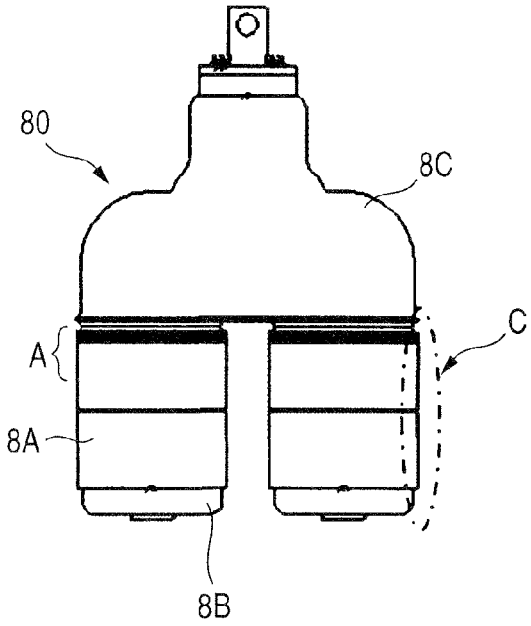
FIG. 6(*a*) and FIG. 6(*b*) are a front view of the vacuum container composing the switching portion 100 shown in FIG. 5, and FIG. 6(*a*) is a plan view of the vacuum container for the switch, and FIG. 6(*b*) is a plan view of the vacuum container for the earthing switch.
Figure 6B:
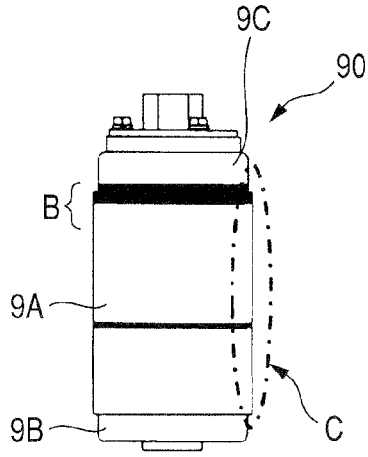
Figure 7:
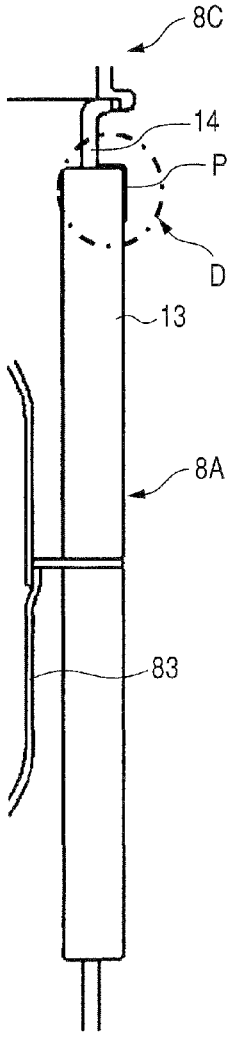
FIG. 7 is a vertical sectional view showing the enlarged part C of the vacuum container composing the switching portion 100 shown in FIG. 6.
Figure 8:
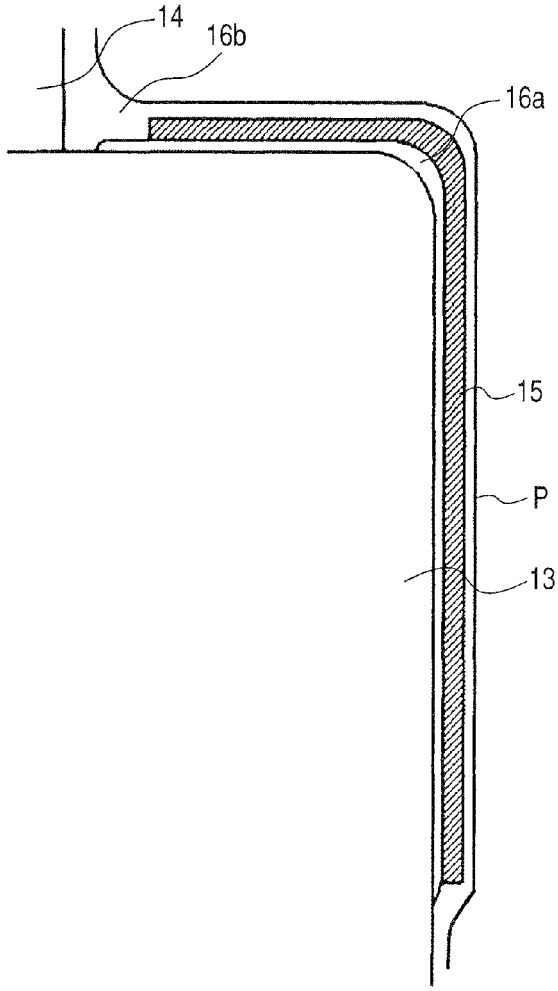
FIG. 8 is a vertical sectional view showing the enlarged part d of the vacuum container composing the switching portion 100 shown in FIG. 7.

Next, the molding procedure for the unitized switching portion 100 composing the vacuum insulating switch gear of the present invention will be explained by referring to FIGS. 5 to 8. FIG. 5 is a front view showing the internal constitution of the switching portion 100 composing the vacuum insulating switch gear of the present invention, and FIG. 6(*a*) and FIG. 6(*b*) is a front view of the vacuum container composing the switching portion 100 shown in FIG. 5, and FIG. 6(*a*) is a plan view of the vacuum container for the switch, and FIG. 6(*b*) is a plan view of the vacuum container for the earthing switch. FIG. 7 is a vertical sectional view showing the enlarged part C of the vacuum container composing the switching portion 100 shown in FIG. 6 and FIG. 8 is a vertical sectional view showing the enlarged part D of the vacuum container composing the switching portion 100 shown in FIG. 7. In FIGS. 5 to 8, the same numerals as those shown in FIGS. 1 to 4 indicate the same portions, so the detailed explanation thereof will be omitted.

In FIG. 5, the dashed line portions show the external form of each component arranged in the switching portion 100. The solid line portions show the external form of the switching portion 100 and cover almost all the outer peripheries of the components with an epoxy resin portion E. Further, numeral 12 indicates a field easing shield of an aluminum ring body for easing the non-uniform electric field and it is arranged in the epoxy resin portion E so as to permit the lower ends of the insulating cylinders 8A and 9A to pass through the centers of the respective ring bodies.

As shown in FIG. 6(*a*), the portion A of the upper end corner portion of the insulating cylinder 8A composing the vacuum container 80 has a formed edge portion of a ceramic member. As mentioned above, the edge portion is a portion for giving thermal stress to the epoxy resin portion, so that it is necessary to install a stress easing layer at the portion. As shown in FIG. 6(*b*), it is necessary to install a stress easing layer similarly at the portion B of the upper end corner portion of the insulating cylinder 9A composing the vacuum container 90.

FIG. 7 is a vertical sectional view of the enlarged part C of the insulating cylinder 8A shown in FIG. 6, and numeral 13 indicates a ceramic member of the insulating cylinder 8A, and numeral 14 indicates a copper flange portion for joining the insulating cylinder 8A and the upper lid 8C. The connection of the upper part of the ceramics insulating cylinder 8A to the stainless steel upper lid 8C is structured so as to solder and connect the other end of the ring copper flange portion 14 one end of which is soldered to the ceramic member 13 of the insulating cylinder to the upper lid 8C, so that on the outer side portion of the upper end of the ceramics member 13 of the insulating cylinder, an edge portion is formed. On the edge portion, a stress easing layer P is installed.

FIG. 8 is a partial vertical sectional view of the enlarged portion D of the edge portion at the corner of the outer cylinder shown in FIG. 7 and the stress easing layer P is formed by forming a self fusing insulating tape layer by winding up a self fusing insulating tape 15 on the silicone rubber layer as a first silicone rubber layer 16*a* coated on the edge portion of the corner of the outer cylinder and furthermore coating silicone rubber as a second silicone rubber layer 16*b* thereon.

Next, the concrete procedure will be explained.

(1) On the upper parts (the portions A and B shown in FIG. 6(*a*) and FIG. 6(*b*)) of the insulating cylinders 8A and 9A of the vacuum containers 80 and 90, silicone rubber is coated as the first silicone rubber layer 16*a*. Concretely, as shown in FIG. 8, for example, plastic resin 16 containing silicone rubber particles is coated to a thickness of about 0.1 mm by a brush. In this case, care should be taken not to include bubbles in it.

(2) The self fusing insulating tape 15 is wound around the corners of the portions A and B shown in FIG. 6(*a*) and FIG. 6(*b*) two or three times to form a self fusing insulating tape layer. Concretely, as shown in FIG. 8, for example, the tape 15 including a main component of butyl rubber which is a self fusing insulating member is wound around the corners two or three times by giving tensile strength onto the silicone rubber coated layer mentioned in (1). As a result, the silicone rubber coated layer fills up air gaps formed in the gap between the self fusing insulating tape 15 and the corner of the insulating cylinder and the self fusing insulating tape 15 presses the silicone rubber coated layer toward the outer surface of the insulating cylinder. Therefore, for example, even if the silicone rubber coated layer is bubbled, bubbles can be pressed outside the coated layer at this step. The layer thickness formed by winding the self fusing insulating tape 15 can be controlled to about 0.3 mm.

(3) The vacuum containers 80 and 90 are coated wholly with silicone rubber as the second silicone rubber layer 16*b* and then are subjected to vacuum deaeration. Concretely, the vacuum containers 80 and 90 are coated wholly with silicone rubber. In this case, silicone rubber is coated so as to control the thickness of the portion other than the layer formed in (2) to about 0.1 mm. The purpose of coating with silicone rubber at this step is to improve the adhesive property of the epoxy resin to the vacuum containers 80 and 90. Hereafter, the vacuum containers 80 and 90 coated with silicone rubber are stored in a vacuum tank with a vacuum pump connected and are kept in the vacuum condition for about 10 minutes or more, thus the silicone rubber coated layer is deaerated.

(4) The silicone rubber is thermoset. Concretely, for example, the vacuum containers 80 and 90 for which the step described in (3) is completed are stored in a thermostatic chamber and are heated at 160° C. for about 4 hours. By doing this, the silicone rubber coated layer is cured. The vacuum containers 80 and 90 after heating are naturally cooled.

(5) The vacuum containers 80 and 90 and the other structures are arranged in a metal mold and epoxy resin is injected. Concretely, for example, so as to insert the lower ends of the insulating cylinders 8A and 9A of the vacuum containers 80 and 90 to which the aforementioned process is performed through the ring field easing shield 12 and to put the portions of the vacuum containers 80 and 90 into a predetermined connection state with the conductors 101 and 102, the components are arranged in a metal mold. Thereafter, epoxy resin is injected into the metal mold. Hereafter, it is cured under a specified condition, thus the switching portion 100 is formed.

According to the aforementioned embodiment of the vacuum insulating switch gear of the present invention, the thermal stress to the epoxy resin composing the mold portion can be eased, so that the crack resistant property and withstand voltage property of the switching portion 100 can be improved. As a result, the reliability of the vacuum insulating switch gear is improved and a vacuum insulating switch gear withstanding long-term use can be provided.

Further, silicone rubber is coated as a base of the self fusing insulating tape 15 and the tape 15 is wound around the silicone rubber, so that the thickness of the stress easing layer can be precisely controlled and separation of the tape interface and generation of bubbles can be prevented. As a result, the crack resistant property and withstand voltage property of the switching portion 100 can be improved.

Furthermore, vacuum deaeration is performed, so that generation of bubbles at the time of curing the silicone rubber can be prevented. As a result, generation of a partial discharge such as a corona discharge can be prevented and the withstand voltage property can be improved.

Further, according to the embodiment of the present invention, the first silicone rubber layer 16*a* and the self fusing insulating tape layer are formed at the corner of the upper end of the insulating cylinder 8A, though, for example, they may be formed on an electrode shield portion 83 installed at the middle of the insulating cylinder 8A and in this case, the insulating property of the switching can be improved even more.

Further, according to the embodiment of the present invention, as a switch composing the switching portion 100, the vacuum double-break three-position type switch (BDS) 8 and the earthing switch with the vacuum closed container (ES) 9 are arranged, though the present invention is not limited to this aspect. To any switch having a vacuum container, the present invention can be applied.

What is claimed is:

1. A vacuum insulating switch gear formed by integrally molding with epoxy resin of a vacuum double-break three-position type switch including a movable contact, a fixed contact, and a vacuum container composed of an insulating cylinder for covering the movable contact and the fixed contact, a lower lid for closing a lower part of the insulating cylinder, and an upper lid for closing an upper part of the insulating cylinder and an operation rod side of the movable contact, and an earthing switch with a vacuum closed container, comprising a first silicone rubber layer coated on an upper edge corner portion of each insulating cylinder composing the vacuum containers of the switch and the earthing switch, a self fusing insulating tape layer wound around an outer surface of the first silicone rubber layer, a second silicone rubber layer coated on the self fusing insulating tape layer and an outer periphery of the each insulating cylinder, a ring easing shield installed at a position corresponding to a lower end corner portion of the each insulating cylinder after a vacuum deaeration process performed for the first and the second silicone rubber layers, and an epoxy resin portion for integrally molding the each vacuum container so as to cover the first silicone rubber layer, the self fusing insulating tape layer, the second silicone rubber layer, and the ring easing shield.

2. The vacuum insulating switch gear according to claim 1, wherein the first silicone rubber layer is thermoset after the vacuum deaeration process.

3. The vacuum insulating switch gear according to claim 1, wherein the second silicone rubber layer is thermoset after the vacuum deaeration process.

4. The vacuum insulating switch gear according to claim 1, wherein on an electrode shield portion installed at the middle of the insulating cylinders, the first silicone rubber layer and the self fusing insulating tape layer are additionally installed.

* * * * *